United States Patent [19]

Clitherow et al.

[11] Patent Number: 5,017,268

[45] Date of Patent: May 21, 1991

[54] FILLER COMPOSITIONS AND THEIR USE IN PAPERMAKING

[75] Inventors: Barbara M. Clitherow, Harpenden; Trevor W. R. Dean, Arlesey; John A. Gascoigne, Hitchin, all of United Kingdom; Bernhard E. Van Issum, Geneva, Switzerland

[73] Assignee: E. I. Du Pont de Nemours and Company, Wilmington, Del.

[21] Appl. No.: 192,879

[22] PCT Filed: Sep. 2, 1987

[86] PCT No.: PCT/GB87/00613

§ 371 Date: Jun. 27, 1988

§ 102(e) Date: Jun. 27, 1988

[87] PCT Pub. No.: WO88/02048

PCT Pub. Date: Mar. 24, 1988

[30] Foreign Application Priority Data

Sep. 9, 1986 [GB] United Kingdom ..... 8621680

[51] Int. Cl.[5] ..... D21H 23/02

[52] U.S. Cl. ..... 162/146; 162/157.2; 162/158; 162/164.1; 162/168.1; 162/175; 162/181.1; 162/181.6; 162/181.8; 162/182; 162/183

[58] Field of Search ..... 162/168.2, 145, 146, 162/181.1, 158, 164.6, 183, 181.6, 181.8, 157.2, 175, 168.1, 169, 182, 164.1

[56] References Cited

U.S. PATENT DOCUMENTS

| | | | |
|---|---|---|---|
| 2,027,090 | 1/1936 | Carter | 92/21 |
| 2,795,545 | 1/1957 | Gluesenkamp | 162/168.2 |
| 2,992,964 | 7/1961 | Werner | 162/178 |
| 3,016,325 | 1/1962 | Pattilloch | 162/164.6 |
| 3,184,373 | 5/1965 | Arledter | 162/164.6 |
| 3,223,581 | 12/1965 | Sommer et al. | 162/157 |
| 3,238,056 | 3/1966 | Pall et al. | 162/146 |
| 3,249,669 | 5/1966 | Jamieson | 264/177 |
| 3,253,978 | 5/1966 | Bodendorf et al. | 162/152 |
| 3,416,952 | 12/1968 | McIntyre et al. | 117/118 |
| 3,625,754 | 12/1971 | Dunn | 117/138.8 |
| 4,007,083 | 2/1977 | Ring et al. | 162/101 |
| 4,137,181 | 1/1979 | Hawkins | 252/8.9 |
| 4,179,543 | 12/1979 | Hawkins | 428/361 |
| 4,225,383 | 9/1980 | McReynolds | 162/146 |
| 4,229,250 | 10/1980 | Lehtinen | 162/23 |
| 4,294,883 | 10/1981 | Hawkins | 428/361 |
| 4,299,654 | 11/1981 | Tlach et al. | 162/178 |
| 4,481,075 | 11/1984 | Dailly et al. | 162/146 |
| 4,529,663 | 7/1985 | Lancaster et al. | 162/146 |
| 4,548,678 | 10/1985 | Laflin et al. | 162/146 |
| 4,609,431 | 9/1986 | Grose et al. | 162/135 |
| 4,610,801 | 9/1986 | Matthews et al. | 162/181.1 |
| 4,643,801 | 2/1987 | Johnson | 162/164.1 |
| 4,711,727 | 12/1987 | Matthews et al. | 162/168.2 |
| 4,810,329 | 3/1989 | Camisa | 162/146 |

FOREIGN PATENT DOCUMENTS

| | | |
|---|---|---|
| 970115 | 7/1975 | Canada . |
| 0080986 | 6/1983 | European Pat. Off. . |
| 0177425 | 4/1986 | European Pat. Off. . |
| WO8604370 | 7/1986 | PCT Int'l Appl. . |
| WO8605826 | 10/1986 | PCT Int'l Appl. . |
| 958430 | 5/1964 | United Kingdom . |
| 1088984 | 10/1967 | United Kingdom . |

OTHER PUBLICATIONS

Abstract Bulletin of the Institute of Paper Chemistry, vol. 53, No. 7, Jan. 1983, p. 839, Abstract No. 7725.

Abstract Bulletin of the Institute of Paper Chemistry, vol. 57, No. 2, Aug. 1986, p. 240, Abstract No. 2018.

*Primary Examiner*—Peter Chin

[57] ABSTRACT

A filler composition that is suitable for use in the manufacture of paper, board, wet-laid non-wovens or other fibrous sheet materials comprises (preferably flocculated) filler particles (e.g. mineral fillers such as clay, talc or calcium carbonate) attached to fibres (e.g. synthetic organic fibres such as polyester or aramid fibres) by means of a coupling agent. These fibres generally have an average fibre length of 4 mm or more. Suitable coupling agents include oligomeric and other polymeric materials such as modified starch, cellulose ethers and derivatives thereof, modified natural gums, ketene dimers or poly(vinyl alcohol). Colloidal silica or colloidal bentonite clay may also be included. The filler composition is preferably added to the stock before the latter reaches the flowbox of the sheet-making machine. The invention allows high levels of filler to be achieved while maintaining satisfactory strength properties, in particular tear strength, in the sheet.

8 Claims, 3 Drawing Sheets

FILLER COMPOSITIONS AND THEIR USE IN PAPERMAKING

FIELD OF THE INVENTION

The present invention relates, in general, to the manufacture of filled fibrous sheet materials and, in particular, to compositions containing a filler, to methods of manufacturing fibrous sheet materials, especially paper, board, nonwovens and composite products, using such filler compositions, to fibrous sheet materials manufactured by such methods, and to dry formulations and concentrated-liquid formulations from which the filler compositions may be prepared.

BACKGROUND OF THE INVENTION

It is common practice in making paper and board to add particulate materials, for example mineral pigments, for filling and loading purposes to the pulp slurry from which the paper or board is made. The common mineral fillers are considerably cheaper than pulp and therefore reduce the cost of the paper or board product; moreover, fillers may be used to improve such properties as the brightness, opacity, handle, ink receptivity and print clarity of the product. However, fillers almost invariably reduce the strength of the product. Furthermore, there is a tendency for filler particles to be lost into the water which drains from the fibrous web formed from the pulp slurry, although the amount of filler that is lost will depend upon many factors such as the particle size and the specific gravity of the filler.

The loss of filler can be reduced by the addition of a retention aid. Certain retention aids act to neutralize the negative charges that develop on the surfaces of the filler particles and fibers and thereby to encourage co-flocculation of the filler and fibers, such charge-biasing retention aids including polymeric flocculating agents having a molecular weight of the order of $10^3$ to $10^5$ and which contain amine or quaternary ammonium groups, for example polyamide-epichlorohydrin condensates or poly(dimethyldiallyammonium chloride). More effective as retention aids, however, are polymeric flocculating agents having higher molecular weights, usually of the order of $10^6$ to $10^7$, amongst which the ionic polymers, especially ionic copolymers, of acrylamide are commonly used, although polyethylene-imines and vinylpyridine polymers are also effective. The high molecular weight polymers may be referred to as "bridging" polymers, since they encourage flocculation by forming molecular bridges between particles to which they are adopted. The use of fillers and retention aids in papermaking is described, for example, in the articles entitled "Paper" and "Papermaking Additives" in the Kirk-Othmer Encyclopedia of Chemical Technology, third edition, volume 16, pages 768 to 825. Interesting flocculations, which may be used in papermaking, e.g. in the presence of cationic starch, were recently disclosed in EP-A-0,172,723. The teaching of these documents is incorporated herein by reference.

U.S. Pat. No. 2,027,090 (Carter) discloses a method of incorporating a substance into paper or the like by dispersing the substance in a continuous phase capable of coagulating to a firm gel, an aqueous solution of viscose cellulose being a particular example of such a phase. The gel is subdivided into particles (as in the papermaking beater). Furthermore, fibers are bound into the gel in such a manner as to protrude from the said gel particles; preferably such fibers are initially introduced into and dispersed throughout the liquid used to make the colloid dispersion which constitutes the said continuous phase. The gel particles are described and illustrated as enveloping, encysting or enclosing the particles of dispersed substance. Carter's method is suitable for incorporating into paper sticky or gummy substances such as a phenol-formaldehyde condensation product, although mineral fillers are mentioned in passing. The said fibers (which serve as "anchors" for the gel particles) ar preferably the same as those of papermaking pulp stock, although rayon and asbestos fibers are also specifically mentioned.

In order to achieve a high filler content whilst maintaining satisfactory strength properties, in particular tensile strength and burst strength, it has been proposed to employ a preflocculated filler composition, that is to say a suspension of filler to which a flocculating agent, in particular a high-molecular-weight synthetic polymer, is added before the filler is incorporated into the papermaking stock (see M. C. Riddell et al., Paper Technology 17(2), 76 (1976) and British Patent Specification No. 1,522,243, the teaching in which is incorporated herein by reference).

It has been found that the incorporation of filler into paper and other fibrous sheet products by conventional procedures gives rise to products having a poor tear strength, with difficulty in maintaining good formation and adequate tensile properties.

SUMMARY OF THE INVENTION

The present invention now provides a filler composition suitable for use in the manufacture of fibrous sheet materials, which composition comprises (a) filler particle, (b) fibers selected from (1) synthetic organic fibers, (2) natural organic fibers having an average fiber length of at least 4 mm and (3) inorganic fibers, and (c) a polymer that is capable of functioning as a coupling agent between the filler particles and the said fibers (b).

It is usually advantageous to employ preflocculated fillers in papermaking and like systems. Accordingly, it is preferred that the present compositions contain (d) a flocculating agent for the filler particles and/or that they contain, as component (c), a polymer or combination of polymers that also functions as a flocculating agent for the filler particles. An adjuvant that enhances the efficacy of the flocculating agent and/or the coupling agent may also be included.

It has been found that the inclusion of the fibers (b) in a filler composition according to this invention can provide an improvement in the tear strength of fibrous sheet materials into which the filler is incorporated, even at high filler levels, whilst maintaining a satisfactory tensile strength. The fibers (b) have also been found, even at high filler contents, to maintain a surprisingly high bulk and porosity in the fibrous sheet material. It is envisaged that the invention will offer significant benefits in processes for the manufacture of wet-laid fibrous sheet products, especially by improving the drainage of water from the web during formation, thereby reducing the drying load, and by permitting increased refining, an increase in filler content or a decrease in grammage (basis weight or weight per unit area) whilst maintaining satisfactory strength properties, notably tear strength, in the finished sheet.

Thus, the present invention also provides a process for the manufacture of a fibrous sheet material, e.g. paper, by dewatering an aqueous slurry of fibers (commonly by the draining of water therefrom), wherein a filler composition according to this invention is added to the slurry of fibers before the dewatering commences. In a continuous process, this means that the filler composition is added to the said slurry of fibers at a point upstream of the zone in which water is drained from the slurry to form the sheet (e.g.. the zone defined by the forming section of a conventional machine for the production of paper, board or wet-laid non-wovens).

The filler composition will usually be added in the form of an aqueous composition, especially one containing preflocculated filler. The present invention also provides a dry or concentrated-liquid formulation containing two or more of the components (a) to (d), and from which such an aqueous filler composition may be prepared by mixing with water and with the remainder, if any, of the said components.

The present invention also provides a fibrous sheet material having distributed therein (preferably flocculated) filler particles, fibers (b) as defined above and a polymeric material that functions as a coupling agent between the said filler particles and the fibers (b).

Figure 1:
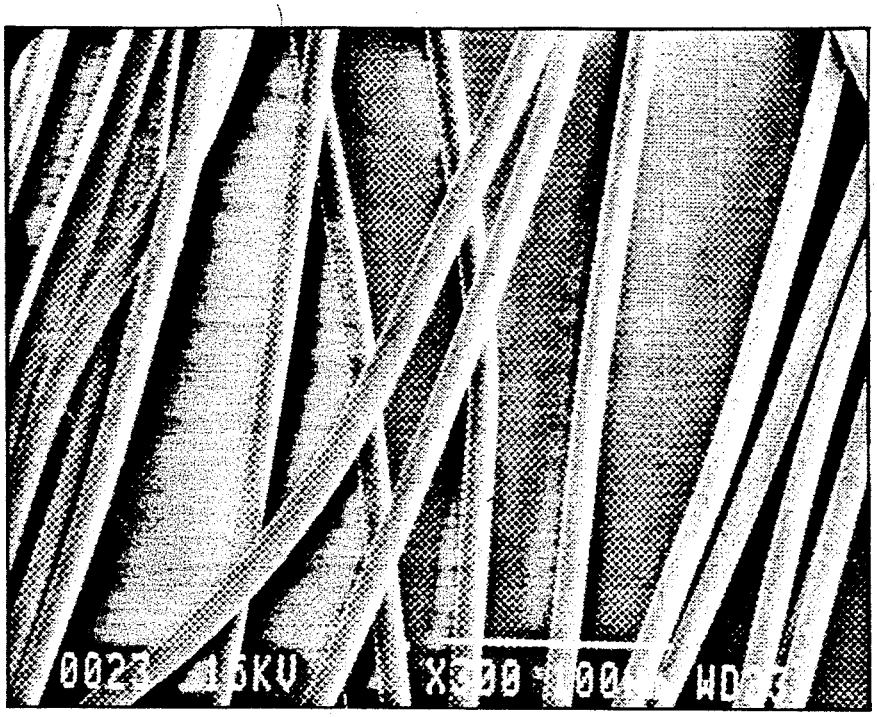
FIG. 1 is a photomicrograph of polyester fibers for use as component (b) before the addition of filler and coupling agent.
Figure 2:
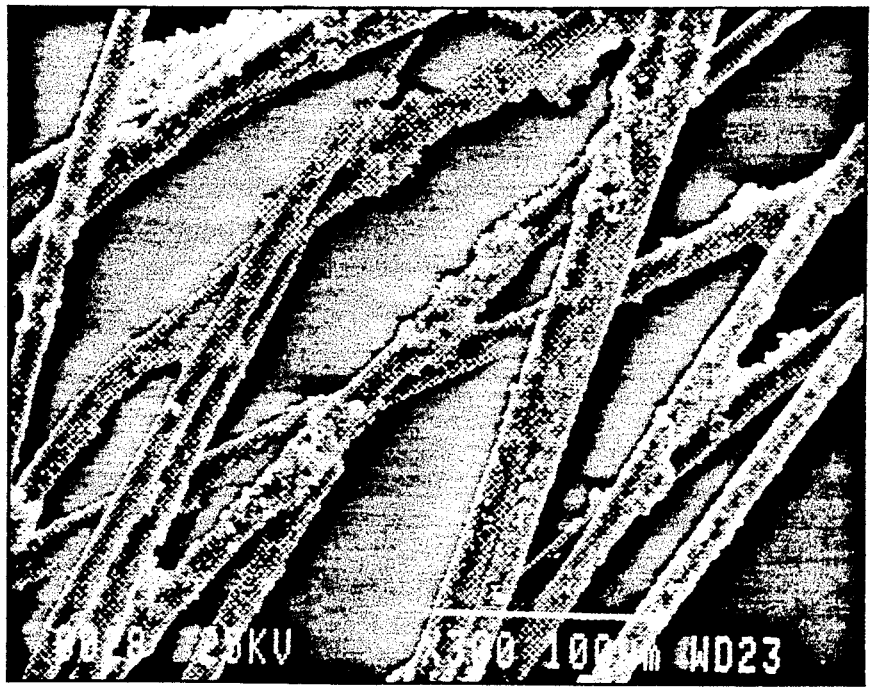
FIG. 2 is a photomicrograph of polyester fibers of the type shown in FIG. 1 to which calcium carbonate filler particles (flocculated with a polyacrylamide) have been coupled with a cationic starch.
Figure 3:
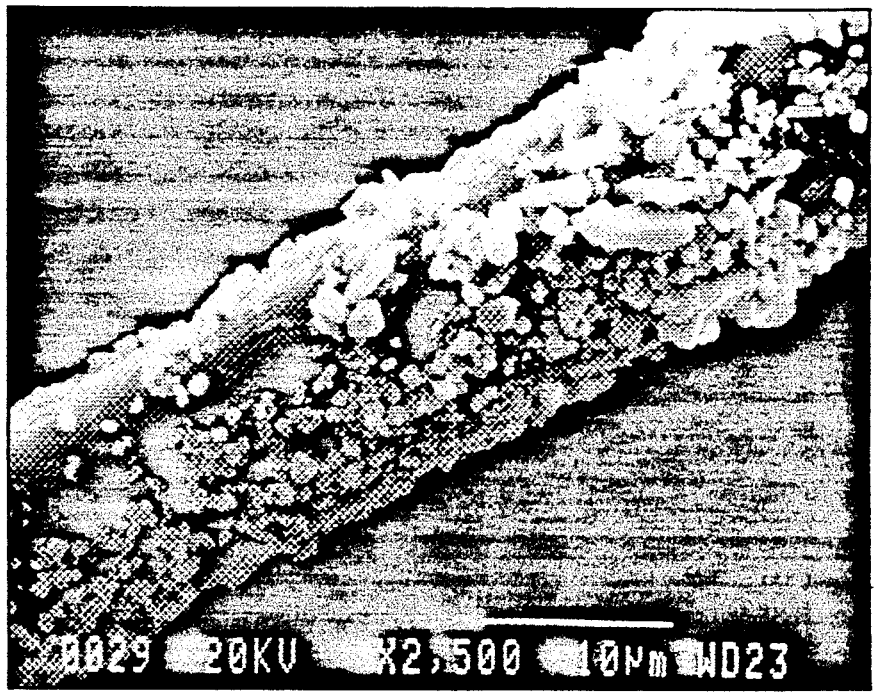
FIG. 3 is a photomicrograph of a fiber from a system similar to that of FIG. 2.
Figure 4:
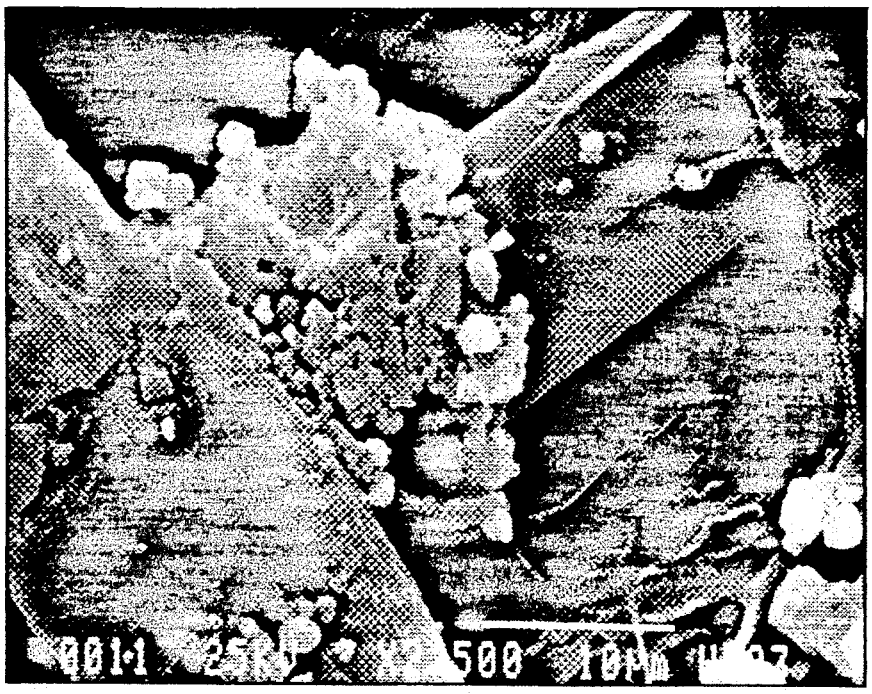
FIG. 4 is a photomicrograph of fibers from a system similar to that of FIG. 2.
Figure 5:
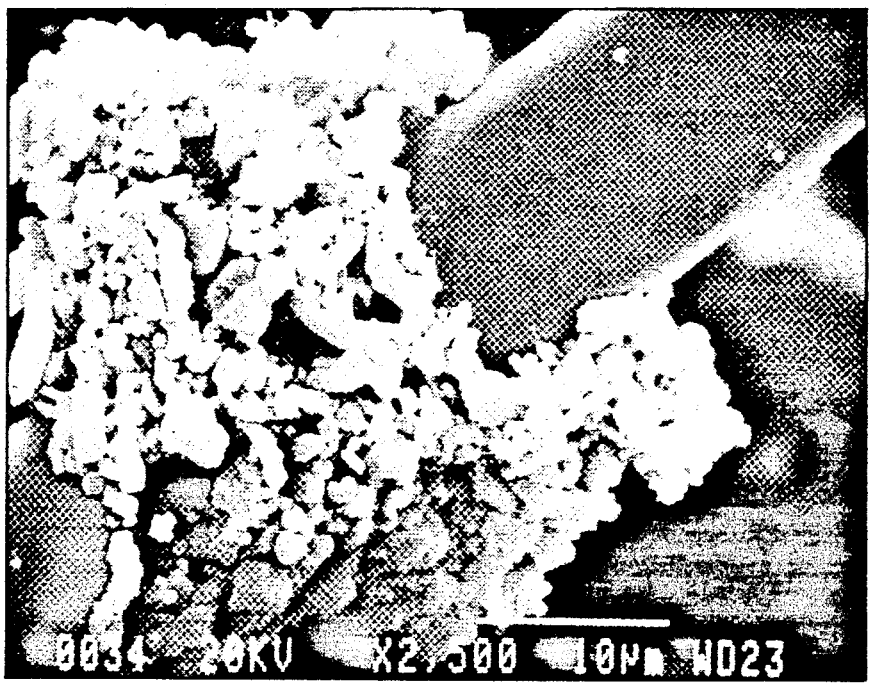
FIG. 5 is a photomicrograph of a polyester fiber to which calcium carbonate filler particles are coupled with a modified guar gum, the latter also acting as a flocculant for the filler particles.

The magnification of FIGS. 3-5 is approx. 8.33 times that of FIGS. 1 and 2.

DESCRIPTION OF PREFERRED EMBODIMENTS

In most cases, a mineral filler will be employed. Any of the conventional mineral fillers may be used, including clay (e.g. kaolin or china clay), titanium dioxide, barium sulfate, zinc sulfide, lithopone, satin white, talc, synthetic silicates (e.g. aluminium silicate), alumina, silica and calcium carbonate (e.g. precipitated calcium carbonate or ground calcium carbonate, such as chalk whiting). However, the synthetic polymeric fillers also come into consideration.

The filler particle size will usually be in the range from 0.1 to 20 μm.

Non-fibrous fillers are, in general, preferred: upon flocculation, a fibrous filler could form knots, clumps or like blemishes that would spoil the formation of the sheet product.

The flocculation of the filler particles may, for example, be effected by using as component (d) any of the flocculating agents, especially the water-soluble synthetic polymers, that could be used conventionally as retention aids in papermaking. It is preferred to use as component (d) a flocculating agent such as an acrylamide polymer (which term includes a copolymer). Suitable polyacrylamides are available under the trade mark "Percol" (Allied Colloids). Good results have been obtained both with anionic flocculation agents and with cationic flocculating agents. In other preferred embodiments, and as described in greater detail hereinafter, the flocculating agent is constituted, wholly or in part, by the same agent or combination of agents that constitutes the component (c).

The filler flocs should not be so large that they become visible to the naked eye in the final product or that they interfere with fiber-fiber bonding and thus adversely affect product performance. Floc size is influenced by various factors, including the amount of flocculating agent and the shear forces to which the filler composition is subjected. Control of such factors is entirely conventional, although, as a guide, the amount of flocculating agent will be usually in the range from 0.01 to 3.0% active substance, preferably from 0.01 to 0.1%, by weight of the filler.

The natural organic fibers that may be used as component (b) of the present filler compositions, by having an average length of at least 4 mm so that tear resistance is improved, are longer than most cellulosic papermaking fibers (which commonly have an average fiber length of 0.5 to 3.5 mm). It is also preferred that inorganic fibers or synthetic organic fibers used as component (b) should also have an average length of at least 4 mm. Commonly, the fibers in component (b) will have an average length of at least 5 or 6 mm and typically up to 26 mm, although fibers having an average length exceeding 26 mm could be used, notably in wet-laid nonwovens. Particularly preferred average fiber lengths are in the range from 4 to 12 mm for paper and board uses.

It seems preferable to use, as component (b), fibers that have an average length greater than that of the fibers that constitute the matrix of the fibrous sheet material (i.e. the fibers in the stock to which the filler composition is to be added). It may be possible, for instance if the matrix fibers are sufficiently short, to modify this invention by using, in or as component (b), natural organic fibers of average fiber length less than 4 mm.

Fiber thickness (i.e. fiber diameter in the case of fibers having a circular cross-section) is preferably from 1 to 50 μm, especially from 5 to 40 μm. Fibers having a non-circular cross-section and/or having an uneven (e.g. rough or crinkled) surface can also be used as component (b). For example, water-dispersible synthetic polymer fiber of cruciform cross-section is disclosed in U.S. Patent Application No. 842,788 filed Mar. 27, 1986 and the corresponding European Application No. 86104816.3, whereas water-dispersible synthetic polymer fiber of scalloped-oval cross-section is disclosed in U.S. Patent Application No. 842,790 filed Mar. 27, 1986 and the corresponding European Application No. 86104815.5. The teaching of the aforesaid applications is incorporated herein by reference.

It is believed that the fibers of non-circular cross-section may offer additional resistance against deflocculation, since the projections (e.g., crests, ridges or lobes) in the fibers may protect the recesses (e.g. valleys, indentations or "saddles") in the fibers from the high shear forces that may be experienced in various zones of the sheet-making system. An uneven fiber surface may also offer protection against the possible stripping of the coupling agent (c) from the fibers by such shear forces.

Component (b) is not limited to true cut fibers but may include or consist of fibrids or other branched or fibrillated species, and the term "fiber" in the context of component (b) is to be construed accordingly. The fibrids or the fibrils (which could be shorter than 4 mm) may have a high surface area and may be capable of self-cohesion and of entrapping filler particles or flocs, thereby enhancing the coupling action and tending to inhibit later deflocculation or decoupling.

The fibers to be included in the filler composition as component (b) are preferably synthetic organic fibers (which expression includes any suitable man-made fiber or regenerated fiber), amongst which polyester fibers (e.g. poly(ethylene terephthalate)), for example those marketed under Du Pont's registered trade mark "Dacron", and aramid (aromatic polyamide) fibers or fibrids, for example those marketed under Du Pont's registered trade mark "Kevlar", have been found to be particularly good, although other fibers, such as polyamides, (e.g. nylon), polyolefins (e.g. polyethylene or polypropylene), acrylics, cellulose acetates, viscose rayon, polyimides and copolymers, can be used. Synthetic organic fibers have been tested for use herein; however, long (average length of 4 mm or more) natural fibers, e.g. bleached kraft pulp from redwood and Parana pine trees, cotton, abaca (Manila hemp), New Zealand flax (Phormium tenax), sisal, mulberry bark, ramie, hemp, sequoia and other plant cellulosic pulp fibers, also come into consideration, as do inorganic fibers, e.g. glass fibers, ceramic fibers and carbon fibers.

The fibers (b), especially the synthetic organic fibers, may have a surface pretreatment before they are incorporated into the filler composition. Synthetic fibers tend to be hydrophobic but can be rendered hydrophilic by appropriate treatment. Thus, the pretreatment is preferably such that the dispersibility of the fibers in water is improved and the application of a surface coating containing polyoxyalkylene groups, notably polyoxyethylene groups, has been found to be suitable. Man-made organic fibers, in particular polyester fibers, with a coating comprising segmented polyethylene terephthalate/polyethylene oxide block copolymer, are especially preferred.

Suitable surface-pretreatments have been disclosed by Ring et al in U.S. Pat. No. 4,007,083, by Hawkins in U.S. Pat. Nos. 4,137,181, 4,179,543 and 4,294,883, and in British Patent No. 958,350, (Viscose Suisse) and Japanese Patent No. 58208499 (Teijin), the teaching of which patent documents is incorporated herein by reference.

The present Applicants consider that the presence of gel particles in any significant quantity could be detrimental in the present compositions since they would spoil the appearance and performance of the paper or other sheet product. Accordingly, the binding of fibers to filler particles by means of gel particles that enclose the filler particles and that are formed by coagulation and subsequent subdivision of a continuous phase in which the filler particles are dispersed, in the manner disclosed in U.S. Pat. No. 2,027,090, is not contemplated as "coupling" in the context of this invention.

The coupling agent (c), which (subject to the preceding disclaimer) bonds, bridges, links or otherwise attaches the filler particles and/or flocs to the fibers (b) (the terms "coupling agent" not of itself implying herein any particular mechanism for the fiber-filler attachment), will usually be selected from polymers (which term in this context includes oligomers, such as dimers, trimers and tetramers, as well as species with higher degrees of polymerization) containing functional groups that are substantive to the filler and functional groups substantive to the fiber (b). Such functional groups include hydroxyl, carboxyl, carboxylic anhydride and ketene groups. The polyhydroxy substances have proved particularly suitable, e.g. polysaccharide-based substances such as starch, mannogalactans and the like, and their derivatives. Usually agents that are hydrophilic, especially those that are soluble or colloidally dispersible in water, are used.

Preferred coupling agents may be selected from starches and modified starches (e.g. cationic or amphoteric starch), cellulose ethers (e.g. carboxymethyl cellulose (CMC)) and derivatives thereof; alginates; cellulose esters; ketene dimers; succinic acid or anhydride polymers; natural gums and resins (especially mannogalactans, e.g. guar gum or locust bean gum) and the corresponding modified (e.g. cationic or amphoteric) natural gums and resins (e.g. modified guar gum); proteins (e.g. cationic proteins), for example soybean protein; poly(vinyl alcohol); and poly(vinyl acetate), especially partially hydrolyzed poly(vinyl acetate). The coupling agents will, for the most part, also act as viscosity boosters and stabilizers, and they may act to improve the hydrophilicity of the fibers.

Cationic starch has been found to be particularly effective as a coupling agent. Cold-water-soluble cationic starch is available under the trade marks "Perfectamyl PLV" (Tunnel Avebe Starches Ltd) and "Solvitose D9" (AB Stadex). Cationic starches that require cooking in order to form an aqueous solution (referred to as "cooked starches" hereinafter) are available under the trade marks "Raisio RS 180", "Raisio RS 190" (Raisio AB) and "Posamyl L7". An amphoteric starch is available under the designation SP-190 (Raisio AB).

Preferably, the cationic starches will have a degree of substitution of at least 0.02, typically from 0.02 to 0.1.

Modified guar gum, for example the amphoteric guar gum that which is available from Meyhall Chemicals under the trade mark "Meyprobond 120", is effective too and has the advantage that it also acts as a flocculating agent for the filler particles. (Cationic starch at a level of 0.5–3% also flocculates filler particles, but the resultant flocs tend to be weak unless a stronger flocculant, such as a polyacrylamide, is also used.) Cationic guar gums are available under the trade marks "Meyproid 9801" (Meyhall AG), "Gendriv 158" and "Gendriv 162" (Henkel Corporation).

Sodium carboxymethylcellulose also works well as a coupling agent, but is sensitive to the papermakers' alum (aluminium sulfate) used in conventional alum/rosin mixing agents. (CMC is a carbohydrate-based substance, as are cationic starch, modified guar gum and alginates; however, as indicated above, substances that are not based on carbohydrates are also useful herein.) It may be advantageous to cationize the coupling agent, notably CMC or an alginate - e.g. by means of dimethyl diallyl ammonium chloride, polyamine-epichlorohydrin and like agents - since cationic polymers are expected to couple more effectively the fibers (b) to the filler particles, which fibers and particles will generally acquire an anionic character in aqueous dispersion.

The coupling agents (c) are not restricted to organic polymers alone. Colloidal silicic acid and bentonite (both of which may be regarded as polyhydroxy compounds when in an aqueous medium) have been described as "anionic polymers" in the literature (see International Patent Specification No. WO 86/05826, page 3, lines 31–32, the teaching of which specification is incorporated herein by reference) and, indeed, these and other colloidal, hydrophilic, inorganic materials, especially polyhydroxy or polyhydrate materials, may be used to increase the efficacy of the coupling agent (c).

A preferred class of such inorganic materials comprises the colloidal silicas, which term herein includes colloidal silicic acid, polysilic acid and colloidal silica sols. These will generally have a particle size of less than 100 nm, usually from 1 to 50 nm. Suitable silicas are available commercially, e.g. from Eka AB or under the trade mark "Ludox" (Du Pont). The aluminium-modified silicic acid sols (see Ralph K. Iler, "The Chemistry of Silica", John Wiley & Sons, N. Y., 1979, pages 407–410) also come into consideration.

The colloidal silicas may be used, for instance, in conjunction with such organic substances as carbohydrates (e.g. cationic starch, amphoteric or cationic guar gum or cationic amylopectin) and/or polyacrylamides. Certain combinations of colloidal silicas or Al-modified silicic acid sols with the aforesaid organics have been proposed as binders in papermaking; see U.S. Pat. Nos. 4,385,961, 4,388,150 and 4,643,801, European Patent Specification No. 0,080,986 A and published International Patent Applications No. WO 8600100 and No. WO. 86/05826 (the teaching of which documents is incorporated herein by reference). However, these documents do not appear to disclose or suggest the use of such silicas in systems wherein preferably flocculated filler particles are coupled to synthetic fibers prior to addition of the filler to the papermaking stock with a view to improving tear strength.

The colloidal silica or the combination thereof with an organic substance may also function as a flocculating agent for the filler particles.

Bentonite and similar colloidal clays may also be used in the present invention, preferably in the compositions containing cationic starch or modified guar gum. The bentonite, for example in conjunction with an anionic polyacrylamide, may act as a coagulant or structure improving aid (see J. G. Langley and E. Litchfield, "Dewatering Aids for Paper Application", TAPPI Papermakers Conference, April 1986). Suitable bentonite clays are available under the trade marks "Organosorb" and "Hydrocol" (Allied Colloids) and a suitable anionic polyacrylamide is available under the trade mark "Organopol" (Allied Colloids). Bentonite may also be used in conjunction with substantially nonionic polymers (such as those described in EP-A-0,017,353 (the teaching of which is incorporated herein by reference).

A study of the photomicrographs of FIGS. 2 to 5 and photomicrographs of other fiber/flocculated filler systems according to this invention has revealed that such coupling agents (c) as cationic starch and amphoteric guar gum attach to the surface of polyester fibers (b) and that the flocculated) filler particles adhere to the coupling agent. The coupling agent has been observed to form a layer, film or coating on the fiber and/or a network or lattice structure attached to the fiber surface (such layers, films, coatings or structures being in some cases discontinuous, patchy or irregular). The attachment of the coupling agent to the fibers has also been shown to occur in the absence of the filler particles (e.g. before addition of the latter). Although it is believed that a similar mechanism for the coupling operates for the other coupling agents (c), and with other fibers (b), this has not yet been verified. It is considered surprising that useful coupling of the filler particles to the fibers (b) may be achieved merely by mixing the fibers and the filler particles in an aqueous system containing the coupling agent in solution or colloidal dispersion. Thus the invention avoids the need for such measures as coagulating an entire dispersion and subdividing the resultant gel.

In addition to attaching the filler particles or flocs to the fibers (b), the coupling agent (owing, for example, to residual cationicity) may, possibly, form bonds between the resultant filler/fiber aggregates and the fibers (e.g. cellulose fibers) that form the matrix of the fibrous sheet material.

Of course, any of the above-discussed components—the filler (a), the fiber (b), the coupling agent (c) and the flocculating agent (d)— may be composed of a mixture of suitable substances.

The filler composition, as added to the fiber slurry from which the fibrous sheet is formed (which slurry is also referred to herein as the stock), will, in general, be in the form of an aqueous dispersion. When preparing the aqueous filler composition, it is desirable to avoid flocculation of the fibers (b), since that could give rise to an unsatisfactory "formation" in the finished sheet. Many of the coupling agents mentioned above do not cause significant flocculation of the fibers (b). Surprisingly, the flocculating agents (d) also appear not to cause significant flocculation of the fibers (b), in particular polyester, aramid and other synthetic fibers; it is thus possible to pre-flocculate the filler in the presence of the fibers (b) and to add the coupling agent subsequently. However, other orders of addition are possible: for example, the fibers (b) can be added to the filler composition after the filler particles have been flocculated; or, as another example, the fiber (b) is added to water, the coupling agent is added next and thereafter the preflocculated filler is admixed. A suitable order of addition for any given set of components can be readily ascertained by simple trials. Of course, the degree of flocculation is affected by other factors, e.g. the time for which, and the energy with which, the system is agitated and the presence of surfactants.

The concentration of filler and of fiber (b) in the aqueous filler composition and the rate at which the latter is added to the stock will depend upon the desired levels of filler and fiber (b) in the finished sheet product. The level of filler is usually from 3 to 80%, preferably from 5 to 50%; the level of fiber (b) is usually from 0.5 to 60%, preferably from 20 to 60% in the case of wet-laid nonwovens or preferably from 1 to 25% and typically from 1 to 5%, in the case of other products, such as paper or board; and the level of coupling agent is usually from 0.01 to 5%, preferably from 0.1 to 5%, the aforesaid percentages being by weight of the finished, dry sheet product.

Although the present invention may be utilized in the manufacture of such fibrous sheet materials as nonwovens, paperboards and composites, it is of particular benefit in the manufacture of paper, especially the commodity papers such as supercalendered paper, magazine paper, newsprint, packaging paper and coated papers, as well as specialty papers. The grammage of the sheet material may vary, depending upon its intended use, but these days will typically be from 45 to 400 g/m$^2$.

Depending, of course, on the intended application and on economic considerations, the fibrous sheet materials will usually be composed primarily of cellulosic fibers, in particular the fibers obtained from vegetable sources, especially wood. Thus, the furnishes used in the production of the fibrous sheet materials may comprise a pulp containing hardwood fibers, softwood fibers or a mixture thereof, and which may be a mechanical, chemimechanical, semichemical or chemical pulp, or may comprise recycled or secondary fibers with or without organic fillers. It is also possible to employ cellulose fibers from nonwood vegetable sources, such as cotton, bagasse, esparto, straw, reed or Manila hemp, either alone or as a blend with wood pulp. The so-called synthetic pulps, for example the fibrillated polyolefin materials, also come into consideration; however, for reasons of cost, these will usually be used with a pulp of vegetable origin. Other fibrous materials may be included in the furnish, e.g. rayon, nylon, aramid, alginate, poly(vinyl alcohol), polyacrylic, polyolefin or copolymer fibers.

The furnish may include any of the conventional papermaking additives, for example draining aids, defoaming agents, wet-strength additives, dry-strength additives, pitch control agents, slimicides, stabilizing agents such as sodium silicate and sizing agents.

The addition to the stock of acrylic polymer latex binders, which are hydrophobic and generally require the use of a special dispersant or emulsifier, is not favored in this invention, since such binders prevent useful recycling in the sheet-making system. The use of such latexes is not however precluded in a coating mix applied after the web has been formed and dried.

Sizing treatment may be effected either by "internal" sizing or by "surface" sizing to render the paper or other sheet material partially hydrophobic. Suitable sizing agents include the conventional rosin/alum systems (although these may preclude the use of acid-reactive fillers such as untreated calcium carbonate), the cellulose-reactive sizing agents such as those based on the long-chain alkylketene dimers (which permit sizing in neutral or alkaline conditions), wax emulsions, succinic acid derivatives, polyalkylene imines and various fluorochemicals.

The inclusion of a ketene dimer in the furnish may be particularly advantageous, in that it can improve the folding endurance of paper and board manufactured in accordance with this invention; this could find use, for example, in a multiply board, where it may be possible to include the filler composition of this invention in only one of the layers. It has also been found that a ketene dimer, especially when used in conjunction with a cellulose either (preferably carboxymethyl cellulose), starch or a starch derivative, can significantly improve the wet strength of the fibrous sheet product. Thus, it may be possible to produce a coated label paper with enough wet strength for it to pass through a bottle-washing plant (e.g. in a brewery) while still allowing the mill to recycle its dry broke without chemical treatment or an excessive consumption of energy.

The procedures and apparatus for preparing, conveying and diluting the stock and for preparing the fibrous sheet material from the stock may be entirely conventional. Such procedures and apparatus are well documented (see, for example, the article entitled "Paper" in the Kirk-Othmer Encyclopedia referred to above) and a detailed discussion herein is considered to be superfluous. It is preferred, however, that the sheet be formed on a continuous or intermittent machine, for example a cylinder machine (VAT), a Fourdrinier machine, a machine having multi-wire formers or an inclined wire machine (as commonly used to produced wet-laid nonwovens).

The (preferably preflocculated) filler composition should be added to the stock at a point in the system which permits the filler particles (or flocs) and the associated fibers (b) to be uniformly distributed in the stock by the time it reaches the web-forming zone; accordingly, the filler composition will normally be added to the furnish before it reaches the flowbox (or headbox) of the papermaking machine. It is also preferred to add the filler composition to the pulp after it has left the beater, since the high-shear conditions that obtain in the beater could break or deform the synthetic organic fibers and/or other fibers used as component (b) and could also cause deflocculation of the filler flocs (agglomerates). It is particularly preferred to add the filler composition to the stock just before the main fan pump, especially at the stock inlet of the main fan pump (being the pump that propels the stock to the flowbox of the machine).

The subsequent addition (e.g. prior to the flowbox) of a further amount of any of the components of the present compositions, especially the flocculating agent and/or the coupling component, is not precluded. Indeed, such additions may be beneficial in repairing any deterioration in properties due, for example, to exposure of the coupled fiber/filler complex to excessive shear forces. Microscopic analysis of samples has suggested that the coupling agent and filler particles or flocs can be disturbed, and even peeled away from the fibers, by excessive shear forces, e.g. in the cleaners. Addition of the flocculant and/or of the colloidal inorganic material separately from the filler composition could also be tried.

As mentioned above, the invention also includes dry or concentrated-liquid formulations from which aqueous compositions containing the, preferably preflocculated, filler can be prepared. For example, a single formulation, or "pack", may contain filler particles, a flocculating agent for the particles, fibers (b) and a coupling agent in appropriate proportions; it is here possible to employ a polymeric material, e.g. modified guar gum, that will function both as the flocculant and as the coupling agent. Alternatively, since fibers suitable for component (b) are readily available, the pack could contain just the filler, flocculating agent and coupling agent. Although the simultaneous dispersion in water of the components when using such a pack may not give optimum results, this may be compensated for by the increased convenience to the manufacturer of the fibrous sheet material. It is, of course, also possible to use multi-part packs, e.g. a two-part pack containing the filler and flocculating agent in one part and the fiber (b) and coupling agent in the other.

The present invention is illustrated in and by the following specific examples.

EXAMPLE 1

Several series of tests were carried out using the following experimental procedure.

PREPARATION OF STOCK

A mixture of 70% bleached eucalyptus Kraft and 30% bleached softwood Kraft was treated in a Valley beater at 1.57% consistency to give a stock with a Canadian Standard Freeness in the range 350° to 450°. Portions of stock containing 24 g (oven-dry basis) of cellulose fiber were withdrawn and disintegrated in a British Standard disintegrator for 15,000 revolutions.

PREPARATION OF FILLER COMPOSITION

Each preflocculated filler composition was prepared as an aqueous suspension, using a small stirrer to agitate the suspension continuously. Various orders of addition of the components were tried, a typical procedure being as follows:

The fiber (b) was dispersed in approximately 500 ml watering a preparation vessel. The appropriate volume of a 1% solution of coupling agent (e.g. cationic starch) was added. An aqueous slurry of filler was made and added to the preparation vessel after the coupling agent. A dilute solution of flocculating agent (e.g. Percol 292) was thereafter added slowly.

The other orders of addition, which are shown in the Tables of results hereinafter, were effected by procedures analogous to that described above. (This should not, of course, be taken as precluding other orders of addition, e.g. addition of the dry compositions to the stock.)

PRODUCTION OF HANDSHEETS

The filler composition was added to the stock and mixed therewith by hand. The resultant suspension was diluted to approximately 0.3% consistency. A total volume of 3 liters of stock was employed in a British Standard sheet-making machine to form handsheets having a grammage of about 70 g/m$^2$ (oven-dry basis). The stirrer was placed in the machine to act as a baffle before the addition of the stock. In the tests in Series 09 and subsequent series the sheet machine was modified, with the intention of increasing the filler retention, by using a restricted throat in order to retard the rate of drainage during formation of the sheet and by replacing the needle valve by an open hose, thereby reducing the vacuum applied to the sheet.

COMPONENTS

A polyester fiber that is commercially available under Du Pont's registered trade mark "Dacron" was employed as the fiber (b) in all but one of the tests in this Example, this polyester fiber having an average fiber length (cut length) of 6 mm and an average fiber diameter of 13 μm.

In Test 05/E3, however, the fiber (b) was a polyester fiber of scalloped-oval cross-section as described in U.S. Patent Application 842,790, the fiber having a cut length of 6 mm.

The fillers were whiting (specifically a ground calcium carbonate supplied under the trade name "Britomya V" or "Britomya S") and kaolin (grade C, from English China Clays).

The flocculating agents were a cationic high-molecular-weight polyacrylamide (supplied by Allied Colloids under the trade mark Percol 292), an anionic high-molecular-weight polyacrylamide (supplied by Allied Colloids under the trade mark Percol 155) and an amphoteric mannogalactan (supplied by Meyhall Chemicals under the trade mark Meyprobond 120 EV, which material also functioned as a coupling agent).

The coupling agents, in addition to the amphoteric mannogalactan, were CMC, a ketene dimer (supplied by Tenneco Malros under the trade mark Keydime DX4), cationic starch (supplied by Tunnel Avebe Starches Ltd. under the trade mark Perfectamyl PLV), calcium alginate and ammonium alginate.

The cationizing agent, when used, was a polyamine-epichlorohydrin supplied by Allied Colloids under the trade mark Percol 1597. In certain tests, papermakers' alum was used to buffer the stock.

TESTING OF THE SHEETS

The handsheets were air-dried and conditioned at 20° C. and 65% relative humidity before being tested.

The grammage was determined in g/m$^2$ on an oven-dry basis.

The level of retained filler was measured by ashing the sheets at 925° C. for one hour and is expressed as a percentage by weight. Where whiting was employed as the filler, the ash (calcium oxide) was calculated to percent calcium carbonate.

The breaking length (expressed in km), the burst factor, the tear factor and the apparent density (expressed in kg/m$^3$) were determined by standard procedures.

The opacity of the sheets was determined by the International Standards Organization (ISO) method, the results in all cases being corrected to a basis weight of 70 g/m$^2$.

The air porosity was measured by the Gurley 20 ounce densometer method and is expressed in s/100 cm$^3$ air.

The tests, as mentioned above, were carried out in series. The sheets prepared in the tests within each series were prepared from a single beating of cellulose pulp; direct comparisons could therefore be made within each series. However, in order to compare results from different series, a parameter is required that is independent of the freeness of the stock. Such a parameter is the residual strength factor or RSF, which is defined as follows:

$$RSF = \frac{S(1)}{S(0)} \times 100$$

$$\text{where } S(0) = \frac{\text{Tear} \times \text{Tensile}}{\text{Grammage}}$$

for a virgin fiber control furnish, and $$S(1) = \frac{\text{Tear} \times \text{Tensile}}{\text{Grammage}}$$

for a test furnish.

Tear : Marx-Elmendorf tear reading in gf.

Tensile : Schopper tensile reading in kgf.

Grammage: Oven-dry in g/m$^2$.

In some experiments, just the parameter S(1) was determined (this being termed the "strength factor") in the absence of a virgin fiber control furnish.

CONTROL TESTS

In order to ascertain clearly the effect of adding the polyester fiber, control tests were carried out using filler compositions from which the polyester fiber was omitted. For a proper comparison, it was necessary to ensure that the grammage and the filler content of the sheet produced in a control test were substantially the same as those of the sheet produced in the corresponding test according to the present invention. Rather than adjust the composition of the fiber furnish, it was found that the grammage and filler content could be regulated more accurately in the control tests by substituting for the polyester a volume of pulp stock containing the same weight of cellulose fiber and diluting that volume to 500 ml. Thus, the design of the control tests was a consequence of the laboratory-scale procedures used in this example and, accordingly, these control tests are not intended to represent a technique known in the prior art.

TEST RESULTS

For brevity, only a selection of the results are shown in the following Tables, which results have been selected primarily to illustrate the various combinations of components that were investigated.

Each test is identified by a number, the first two digits of which refer to the series. The letter C denotes a control test and is followed by the identification number within the particular series, whereas the letter E denotes a test according to the present invention and is also followed by an identification number within the appropriate series. The amount of polyester is expressed as a percentage by weight on the cellulose fiber; the amount of filler (whiting or kaolin) is expressed as a percentage by weight on total fiber; the amount of Percol 292 is expressed as a percentage by weight on the total of fiber and filler; the amount of each remaining additive is expressed as a percentage by weight on the total furnish; and the test results are expressed, where appropriate, in the units mentioned above.

The numbers in brackets refer to the order of addition in the preparation of the filler composition; in certain cases, some components were pre-mixed, giving identical numbers, whereas in certain other cases a component was added in two portions, giving two numbers for that component.

TABLE 1

| | (Example 1) | | | |
|---|---|---|---|---|
| Test | 01/E2 | 01/E3 | 01/E4 | 01/E5 |
| Polyester | 5(1) | 5(2) | 5(3) | 5(3) |
| Kaolin | 38.1(2) | 38.1(3) | 38.1(2) | 38.1(2) |
| Percol 292 | 0.43(4) | 0.43(5) | 0.43(4) | 0.43(5) |
| Calcium alginate | 0.14(3) | 0.14(1) | — | — |
| Ammonium alginate | — | — | 0.14(1) | 0.14(1) |
| Alum | — | 2.59(4) | — | 2.59(4) |
| Grammage | 69.9 | 67.2 | 67.6 | 64.3 |
| Filler retained | 22.2 | 20.1 | 22.9 | 21.6 |
| Breaking length | 4.82 | 4.05 | 4.64 | 4.59 |
| Burst Factor | 32.3 | 27.0 | 33.2 | 31.3 |
| Tear Factor | 119 | 111 | 120 | 122 |
| App. Density | 659 | 636 | 614 | 630 |
| Opacity | 85.3 | 87.4 | 83.0 | 85.9 |
| Air Porosity | — | — | — | — |
| Strength Factor | 4.01 | 3.02 | 3.77 | 3.60 |

TABLE 2

| | (Example 1) | | | | | | | |
|---|---|---|---|---|---|---|---|---|
| Test | 02/E2 | 02/E5 | 02/E6 | 04/E1 | 04/C3 | 04/E3 | 04/C4 | 04/E4 |
| Polyester | 5(1) | 5(1) | 5(1) | 5(1) | — | 5(1) | — | 5(2) |
| Britomya V | 38.1(3) | 38.1(3) | 38.1(4) | 38.1(2) | 40.0(1) | 38.1(3) | 40.0(2) | 38.1(3) |
| Percol 292 | 0.29(4) | 0.62(4) | 0.62(2,5) | 0.03(4) | 0.03(3) | 0.32(2) | 0.32(1) | 0.09(4) |
| CMC | — | — | 0.14(3) | 0.14(3) | 0.14(2) | 2.01(4) | 2.01(3) | 0.14(1) |
| Keydime DX4 | 0.057(2) | — | — | — | — | — | — | 0.057(1) |
| Percol 155 | — | — | — | — | — | — | — | — |
| Percol 1597 | — | 0.009(2) | — | 0.017(3) | 0.017(2) | — | — | — |
| Meyprobond 120EV | — | — | — | — | — | — | — | — |
| Perfectamyl PLV | — | — | — | — | — | — | — | — |
| Grammage | 70.0 | 70.1 | 77.2 | 66.7 | — | 67.4 | 69.3 | 66.2 |
| Filler retained | 26.8 | 26.0 | 28.6 | 26.0 | (a) | 27.2 | 29.9 | 25.7 |
| Breaking length | 3.87 | 4.08 | 3.45 | 4.53 | — | 4.84 | 4.72 | 3.94 |
| Burst Factor | 25.4 | 30.2 | 22.3 | 31.2 | — | 35.6 | 35.2 | 27.3 |
| Tear Factor | 102 | 108 | 95 | 111 | — | 118 | 91 | 117 |
| App. Density | 631 | 631 | 622 | 600 | — | 605 | 661 | 580 |
| Opacity | 84.8 | 82.9 | 81.4 | 82.0 | — | 82.4 | 85.3 | 81.5 |
| Air Porosity | — | 4.7 | 3.3 | 6.8 | — | 6.9 | 14 | 5.1 |
| RSF | 45.5 | 50.5 | 41.4 | 53.9 | — | 61.5 | 47.8 | 49.0 |
| Test | 04/C5 | 04/E6 | 05/E1 | 05/C2 | 05/E3 | 05/E6 | 06/E5 | 06/E8 |
| Polyester | — | 5(1) | 5(1) | — | 5(1)(b) | 5(1) | 5(1) | 5(1) |
| Britomya V | 40.0(2) | 38.1(3) | 38.1(3) | 40.0(2) | 38.1(3) | 38.1(3) | 38.1(3) | 38.1(2) |
| Percol 292 | 0.09(3) | 0.33(2) | 0.32(2) | 0.32(1) | 0.32(2) | 0.63(2) | 0.32(2) | 0.09(4) |
| CMC | 0.14(1) | — | 1.00(4) | 1.00(3) | 1.49(4) | 1.00(4) | 1.00(4) | 0.14(3) |
| Keydime DX4 | 0.057(1) | 2.08(4) | — | — | — | — | — | — |
| Percol 155 | — | — | — | — | — | — | — | — |
| Percol 1597 | — | — | — | — | — | — | — | 0.017(3) |
| Meyprobond 120EV | — | — | — | — | — | — | — | — |
| Perfectamyl PLV | — | — | — | — | — | — | — | — |
| Grammage | 59.2 | 71.5 | 67.5 | 73.7 | 71.8 | 69.7 | 72.8 | 66.5 |
| Filler retained | 31.0 | 28.7 | 27.6 | 29.4 | 27.8 | 28.4 | 27.7 | 27.7 |
| Breaking length | 4.16 | 3.60 | 4.48 | 4.70 | 4.45 | 4.21 | 4.84 | 4.62 |
| Burst Factor | 24.1 | 23.0 | 31.4 | 33.0 | 30.3 | 27.9 | 32.5 | 30.1 |
| Tear Factor | 85 | 102 | 113 | 82 | 112 | 112 | 110 | 108 |
| App. Density | 628 | 631 | 596 | 668 | 614 | 582 | 621 | 618 |
| Opacity | 83.2 | 88.2 | 82.3 | 85.4 | 82.2 | 82.2 | 83.6 | 86.6 |
| Air Porosity | 4.8 | 4.3 | 5.8 | 12 | 8.7 | 5.6 | 16 | 12 |
| RSF | 33.3 | 42.1 | 56.0 | 46.7 | 59.6 | 50.1 | 61.4 | 52.7 |
| Test | 06/E10 | 07/E1 | 07/E2 | 07/E3 | 07/E4 | 07/E5 | 08/E1 | |
| Polyester | 5(1) | 5(1) | 5(1) | 5(1) | 5(1) | 5(1) | 1(1) | |
| Britomya V | 76.2(3) | 38.1(3) | 38.1(3) | 38.1(3) | 38.1(3) | 38.1(2) | 38.1(3) | |
| Percol 292 | 0.32(2) | 0.014(2) | 0.021(2) | 0.028(2) | 0.005(2) | — | 0.014(2) | |
| CMC | 1.00(4) | 1.00(4) | 1.00(4) | 1.00(4) | 1.00(4) | — | 1.00(4) | |
| Keydime DX4 | — | — | — | — | — | — | — | |
| Percol 155 | — | — | — | — | — | — | — | |
| Percol 1597 | — | — | — | — | — | — | — | |
| Meyprobond 120EV | — | — | — | — | — | 2.01(3) | — | |

TABLE 2-continued (Example 1)

| | | | | | | | |
|---|---|---|---|---|---|---|---|
| Perfectamyl PLV | — | — | — | — | — | — | — |
| Grammage | 63.8 | 65.4 | 66.8 | 67.0 | 66.0 | 60.6 | 68.4 |
| Filler retained | 39.9 | 21.5 | 24.5 | 24.1 | 18.1 | 23.4 | 24.1 |
| Breaking length | 3.52 | 5.30 | 5.01 | 5.06 | 5.62 | 5.38 | 5.20 |
| Burst Factor | 23.6 | 37.0 | 35.5 | 36.2 | 35.8 | 36.0 | 36.2 |
| Tear Factor | 94 | 117 | 118 | 113 | 131 | 120 | 107 |
| App. Density | 566 | 662 | 652 | 650 | 653 | 623 | 677 |
| Opacity | 79.4 | 82.8 | 83.2 | 82.7 | 83.2 | 81.4 | 83.4 |
| Air Porosity | 9.0 | 15 | 14 | 13 | 16 | 11 | 14 |
| RSF | 33.5 | 62.6 | 60.9 | 59.2 | 75.3 | 60.6 | 52.6 |
| Test | 08/E2 | 08/E3 | 08/E4 | 08/E8 | 08/E11 | 10/E1 | 10/E2 |
| Polyester | 2.5(1) | 5(1) | 7.5(1) | 5(1) | 5(1) | 5(1) | 5(1) |
| Britomya V | 38.1(3) | 38.1(3) | 38.1(3) | 38.1(3) | 38.1(2) | 38.1(2) | 38.1(2) |
| Percol 292 | 0.014(2) | 0.014(2) | 0.014(2) | — | 0.007(4) | — | — |
| CMC | 1.00(4) | 1.00(4) | 1.00(4) | — | 0.60(3) | — | — |
| Keydime DX4 | — | — | — | — | — | — | — |
| Percol 155 | — | — | — | 0.021(2) | — | — | — |
| Percol 1597 | — | — | — | — | 0.017(3) | — | — |
| Meyprobond 120EV | — | — | — | — | — | 1.00(3) | 0.50(3) |
| Perfectamyl PLV | — | — | — | 1.09(4) | — | — | — |
| Grammage | 68.6 | 67.7 | 68.8 | 68.4(c) | 67.8 | 66.5 | 65.0 |
| Filler retained | 24.6 | 23.4 | 23.3 | 24.6 | 20.1 | 23.5 | 24.7 |
| Breaking length | 4.64 | 4.59 | 4.57 | 5.58 | 5.16 | 5.44 | 5.22 |
| Burst Factor | 33.6 | 32.1 | 29.4 | 36.6 | 32.8 | 37.4 | 38.0 |
| Tear Factor | 111 | 120 | 130 | 123 | 123 | 127 | 123 |
| App. Density | 687 | 670 | 624 | 577 | 616 | 597 | 567 |
| Opacity | 83.2 | 82.6 | 84.1 | 81.6 | 83.4 | 80.3 | 79.5 |
| Air Porosity | 12 | 9.7 | 8.2 | 6.2 | 8.6 | 7.9 | 6.0 |
| RSF | 48.6 | 51.5 | 56.6 | 64.9 | 59.5 | 62.6 | 56.8 |

| Test | 10/E3 | 10/C2 | 10/E5 | 10/E6 | 10/C4 |
|---|---|---|---|---|---|
| Polyester | 5(1) | — | 5(1) | 5(1) | — |
| Britomya V | 38.1(2) | 40.0(1) | 38.1(3) | 38.1(3) | 40.0(2) |
| Percol 292 | — | — | — | — | — |
| CMC | — | — | — | — | — |
| Keydime DX4 | — | — | — | — | — |
| Percol 155 | — | — | 0.014(4) | 0.005(4) | 0.014(3) |
| Percol 1597 | — | — | — | — | — |
| Meyprobond 120EV | 0.10(3) | 0.10(2) | — | — | — |
| Perfectamyl PLV | — | — | 1.49(2) | 1.49(2) | 1.55(1) |
| Grammage | 68.9 | 65.8 | 66.5 | 64.8 | 64.4 |
| Filler retained | 26.3 | 21.4 | 22.2 | 20.9 | 24.8 |
| Breaking length | 4.77 | 5.12 | 5.80 | 5.96 | 6.07 |
| Burst Factor | 32.8 | 35.2 | 41.6 | 44.0 | 45.1 |
| Tear Factor | 114 | 100 | 124 | 126 | 97 |
| App. Density | 626 | 713 | 654 | 634 | 714 |
| Opacity | 82.1 | 83.8 | 83.7 | 83.0 | 84.3 |
| Air Porosity | 7.4 | 11.6 | 7.7 | 7.4 | 11.2 |
| RSF | 51.1 | 44.7 | 65.1 | 66.3 | 51.8 |

(a) very uneven distribution of filler; sheet properties not tested.
(b) scallopped-oval cross-section.
(c) large flocs present in sheet.

TABLE 3

(Example 1)

| Test | 11/E1 | 11/C3 | 11/E2 | 11/C4 | 11/E3 | 11/C5 | 11/E4 |
|---|---|---|---|---|---|---|---|
| Polyester | 5(1) | — | 5(1) | — | 5(1) | — | 5(1) |
| Britomya S | 38.1(3) | 40.0(2) | 38.1(3) | 40.0(2) | 38.1(3) | 40.0(2) | 38.1(3) |
| Kaolin | — | — | — | — | — | — | — |
| Percol 292 | 0.014(4) | 0.014(3) | 0.014(4) | 0.014(3) | 0.014(4) | 0.014(3) | 0.014(4) |
| Perfectamyl PLV | 0.50(2) | 0.52(1) | 1.00(2) | 1.04(1) | 1.49(2) | 1.55(1) | 2.01(2) |
| Alum | — | — | — | — | — | — | — |
| Grammage | 67.4 | 66.3 | 66.8 | 63.9 | 71.6 | 65.6 | 65.2 |
| Filler retained | 22.7 | 22.3 | 21.2 | 20.2 | 17.7 | 20.0 | 16.2 |
| Breaking length | 4.63 | 5.25 | 4.89 | 5.85 | 6.34 | 5.94 | 6.49 |
| Burst Factor | 30.5 | 33.7 | 37.7 | 43.9 | 45.9 | 45.6 | 47.8 |
| Tear Factor | 116 | 90 | 118 | 98 | 130 | 99 | 128 |
| App. Density | 624 | 655 | 630 | 638 | 602 | 680 | 616 |
| Opacity | 83.9 | 83.2 | 83.0 | 83.1 | 83.0 | 82.9 | 82.2 |
| Air Porosity | 3.6 | 6.8 | 3.8 | 5.9 | 4.9 | 5.1 | 4.4 |
| RSF | 49.5 | 42.9 | 52.3 | 49.7 | 80.2 | 52.4 | 74.1 |
| Test | 11/C6 | 12/E1 | 12/E3 | 12/E4 | 12/E9 | 13/C4 | 13/E4 |
| Polyester | — | 5(1) | 5(1) | 5(1) | 5(1) | — | 8.3(1) |
| Britomya S | 40.0(2) | 38.1(3) | — | — | — | 120(2) | 120(3) |
| Kaolin | — | — | 38.1(3) | 38.1(3) | 38.1(3) | — | — |
| Percol 292 | 0.014(3) | 0.014(4) | 0.016(4) | 0.014(4) | 0.014(4) | 0.068(3) | 0.068(4) |

TABLE 3-continued

| (Example 1) | | | | | | | |
|---|---|---|---|---|---|---|---|
| Perfectamyl PLV | 2.08(1) | 1.49(2) | 1.49(2) | 1.49(2) | 1.49(2) | 2.01(1) | 1.99(2) |
| Alum | — | — | — | (d) | (e) | — | — |
| Grammage | 64.4 | 63.1 | 62.8 | 66.9 | 67.6 | 67.4 | 64.9 |
| Filler retained | 20.6 | 16.7 | 17.4 | 19.2 | 21.0 | 49.5 | 49.8 |
| Breaking length | 6.34 | 6.41 | 6.22 | 4.25 | 4.46 | 2.62 | 2.35 |
| Burst Factor | 48.7 | 46.7 | 45.4 | 26.5 | 28.9 | 19.5 | 14.8 |
| Tear Factor | 93 | 123 | 127 | 114 | 109 | 62 | 79 |
| App. Density | 688 | 627 | 646 | 633 | 637 | 705 | 671 |
| Opacity | 82.5 | 82.4 | 83.2 | 85.1 | 86.4 | 88.2 | 88.4 |
| Air Porosity | 6.2 | 6.0 | 9.0 | 8.4 | 6.4 | 2.2 | 1.7 |
| RSF | 51.6 | 75.6 | 75.4 | 49.3 | 50.0 | 17.8 | 19.5 |

(d) stock buffered to pH 5.0 with 5% alum solution at all stages
(e) stock buffered to pH 5.0 with 5% alum solution but no extra alum added to sheet machine.

DISCUSSION

The experimental results show that the tearing resistance of the paper hand sheets was improved by the inclusion of the polyester fiber. Thus, taking two systems having similar retained-filler contents, the paper sheet of Test 04/E3 had a tear factor of 118, whereas that of Control test 04/C4 had a tear factor of only 91; similarly, the handsheet of Test 05/E1 showed a tear factor of 113, whereas that of Control Test 05/C2 had a tear factor of only 82. The results obtained from Tests 08/E1-08/E4 suggest that the tear factor increases in relation to the proportion of polyester fiber in the furnish.

The experimental results also indicate that the presence of the polyester fiber reduces the apparent density of the sheet (i.e. increases the bulk) while improving the air porosity. Thus, the apparent density in the Test 04/E3 is 605 kg/m$^3$, compared with 661 kg/m$^3$ in Control Test 04/C4, and the Gurley air porosity in Test 04/E3 is 6.9 s/100 cm$^3$ air, compared with 14 s/100 cm$^3$ air in Control Test 04/C4. Similarly, compared with Control Test 05/C2, Test 05/E1 shows a lower apparent density (596 kg/m$^3$, as against 668 kg/m$^3$) and an improved Gurley air porosity (5.8 s/100 cm$^3$ air, as against 12 s/100 cm$^3$ air). These consequences of the inclusion of the fiber (b) in accordance with the present invention are expected to increase the runnability of the sheet-making machine and to decrease the load on the drying cylinders, thereby reducing the process costs.

Tests 07/E1-E4 demonstrated that, in the practice of this invention, the polyacrylamide used as the flocculating agent and retention aid could be reduced: although the filler content of the handsheets was decreased, the filler flocs were less intrusive (due to smaller size) and the appearance of the handsheets was more acceptable.

In these experiments, the anionic polyacrylamide (Percol 155) was found to be a more effective flocculating agent than the cationic polyacrylamide (Percol 292). Thus, large flocs were present in the sheet prepared in Test 08/E8.

Analysis of the results in Tests 11/E4 and the corresponding controls 11/C3-11/C6 shows that an increase in the quantity of cationic starch in the filler system increases the residual strength of the resultant sheet up to an optimum starch addition of 1.5%. However, this is due primarily to the effect of the starch on the burst and tensile strengths, whereas the handsheets prepared from a stock to which polyester fiber was added in accordance with the present invention showed a significant improvement in tearing resistance.

In Tests 12/E1 and 12/E3, when the same quantity of clay was substituted for whiting, the retained filler content and strength of the sheets were similar. However, when the papermaker's alum (aluminium sulfate) was added to reduce the pH (as could occur when using a rosin-based sizing agent), the sheet strength was reduced. This suggests that in practice, a neutral sizing system (e.g. ketone dimer) may prove preferable.

Although all of the coupling agents tested could be utilized with the polyester fiber as an additive to the filler composition, the results suggest that CMC and cationic starch were the most effective for the purpose of maintaining the strength of the filled paper sheets. The results also indicate that the amphoteric mannogalactan (Meyprobond 120EV) could function as both the flocculating agent and the coupling agent. Thus, even at a level of 0.1%, the amphoteric mannogalactan enabled the retention of more than 20% filler, but higher strengths were obtained at levels of 0.5 to 1% of that additive.

Of course, as the filler becomes dominant in the sheet (about 40% filler) the improvement in the residual strength factor due to the inclusion of the fiber (b) in accordance with this invention becomes less market. Nevertheless, even at the high filler levels shown in Test 13/E4 and Control Test 13/C4, the polyester-containing sheet in accordance with this invention still shows an 8.7% advantage (the difference between Tests 13/E4 and 13/C4 expressed as a percentage). Furthermore, even at such a high level of filler, the polyester-containing sheet prepared in accordance with this invention maintains a surprisingly high bulk (low apparent density).

EXAMPLE 2

Handsheets were prepared using the general procedure described above for Example 1, except that the stock was an Irving bleached softwood Kraft beaten to 440° Canadian standard freeness mixed with recycled fibers (waste newsprint or a mixed white waste). The fiber (b) was the commercially available polyester fiber used in Example 1.

Results are shown in Table 4 hereinafter. The amounts of the stock fibers are expressed as a percentage by weight of the total cellulose fiber; the amounts of the other components and the test results are expressed as in Example 1.

TABLE 4

| | (Example 2) | | | |
|---|---|---|---|---|
| Test: | 14/C3 | 14/E1 | 14/C5 | 14/E2 |
| Bleached softwood Kraft | 34.2 | 34.2 | 34.2 | 34.2 |
| Waste newsprint | 65.8 | 65.8 | — | — |
| Mixed white waste | — | — | 65.8 | 65.8 |
| Polyester fibre | — | 4.8(1) | — | 4.8(1) |

TABLE 4-continued

| Test: | (Example 2) 14/C3 | 14/E1 | 14/C5 | 14/E2 |
|---|---|---|---|---|
| Britomya V | 39.9(2) | 38.0(3) | 39.9(2) | 38.0(3) |
| Percol 292 | 0.014(3) | 0.014(4) | 0.014(3) | 0.014(4) |
| Perfectamyl PLV | 1.56(1) | 1.51(2) | 1.56(1) | 1.51(2) |
| Grammage | 64.1 | 70.8 | 62.5 | 62.6 |
| Filler retained | 21.9 | 21.5 | 14.1 | 12.8 |
| Breaking length | 4.01 | 3.89 | 4.59 | 4.37 |
| Burst factor | 27.3 | 26.7 | 33.8 | 32.9 |
| Tear factor | 84 | 115 | 87 | 122 |
| App. density | 560 | 556 | 669 | 621 |
| Opacity | 97.3 | 96.7 | 86.8 | 86.3 |
| Air porosity | 25 | 19 | 9.9 | 6.9 |
| RSF | 51.3 | 75.2 | 69.3 | 92.3 |

EXAMPLE 3

Handsheets were prepared using the general procedure described above for Example 1, except that the order of addition of the components of the preflocculated filler composition was as follows:

1. 5% of fiber (b) by weight of the cellulose fiber.
2. 1.5% cationic starch by weight of total furnish.
3. 38.1% filler by weight of total fiber.
4. 0.014% cationic polyacrylamide by weight of total furnish.

As in the preceding Examples, the additions are calculated on the basis of oven-dry fiber.

Several series of experiments were carried out using various fibers (b), including not only polyester fibers but also other synthetic fibers and rayon fibers, each of average fiber length exceeding 4 mm (except for the polyethylene fibrids of Test 8, which may have been shorter than 4 mm), and using, as the filler, either whiting of kaolin clay (the latter being used in systems containing papermaker's alum). The aramid fibers of Test 10 exhibited fibrillation. The residual strength factor (RSF) and the retained filler content of the handsheets were ascertained, and the results are summarized in the following Table 5.

TABLE 5

(Example 3)

| Test | Fibre (b) | Filler: Whiting RSF % | Whiting Filler Content % | Clay (with Alum) RSF % | Clay (with Alum) Filler Content % |
|---|---|---|---|---|---|
| 1 | Dacron | 84.6 | 18.1 | 69.0 | 18.3 |
| | polyester | 77.8 | 19.0 | — | — |
| | | 71.2 | 21.5 | — | — |
| 2 | Copolyester | 64.4 | 19.7 | — | — |
| 3 | Acrylic | 63.1 | 21.7 | — | — |
| 4 | Polyamide, Nylon 66 | 64.4 | 19.9 | 52.9 | 20.2 |
| 5 | Rayon | 66.2 | 19.0 | — | — |
| 6 | Rayon (Zellwolle) | 77.3 | 21.9 | 59.4 | 18.6 |
| 7 | Polypropylene | 64.9 | 19.9 | — | — |
| 8 | Polyethylene Fibrid | 67.6 | 19.6 | 48.7 | 16.7 |
| 9 | Polyamide Nylon 6 | 84.2 | 21.5 | 64.3 | 18.7 |
| 10 | Aramid | 91.9 | 18.1 | 66.9 | 17.9 |

EXAMPLE 4

Several series of tests were carried out using an experimental procedure analogous to that of Example 1, except as stated below.

PREPARATION OF STOCK

A mixture of 70% bleached eucalyptus Kraft and 30% bleached softwood Kraft was treated in a Valley beater to give a quantity of cellulose stock of Canadian Freeness 400–450°. Each load of pulp from the beater was used to prepare the sets of one series.

PREPARATION OF FILLER COMPOSITION

Various filler compositions according to this invention were prepared.

A number were prepared by first dispersing the fiber (b) in water, then adding an aqueous solution of cationic starch (as the coupling agent), an aqueous slurry of filler particles and a dilute solution of a polyacrylamide flocculating agent. In some cases, bentonite was added as the final component of the filler composition.

Others of the compositions were prepared by a similar procedure, but omitting the bentonite and substituting colloidal silica for the polyacrylamide.

The components (and their order of addition) of the remaining compositions will be clear from Tables 6 and 7 hereinafter.

PRODUCTION OF HANDSHEETS

The filler composition was added to a portion of the cellulose stock and diluted to a total volume of 8 liters. The diluted stock was used to form handsheets in a British standard sheet-making machine.

COMPONENTS

The fiber (b) was a polyester fiber commercially available under the trade mark "Dacron" (Du Pont) and having an average cut length of 6 mm and an average fiber diameter of 13 μm.

The filler was a ground calcium carbonate supplied under the trade name "Britomya M".

The cationic starch was selected from the cold-water-soluble starches sold under the trade names "Perfectamyl PLV" (degree of substitution, d.s. - 0.035) and "Solvitose D9" (d.s. 0.100) and the cooked starches "Raisio RS 180" (d.s. 0.035), "Raisio RS 190" (d.s. 0.042) and "Posamyl L7" (d.s. - 0.048).

The flocculating agent was selected from the cationic high-molecular-weight polyacrylamides "Percol 292" and "Percol 63" and the anionic high-molecular weight polyacrylamide "Percol 155" (all from allied Colloids).

The colloidal silica was selected from Ludox (trade mark) HS 40 (Na as a counterion, negative particle charge, average particle diameter 12 nm) from Du Pont and "Silica BMA", being a silica of the type used in the Eka "Composil" (trade mark) process. The bentonite was an amphoteric bentonite clay supplied under the trade name "Hydrocol O" by Allied Colloids.

TESTING OF THE SHEETS

The testing was carried out using the procedures described in Example 1.

TEST RESULTS

For brevity, only a selection of the results are shown in Tables 6 and 7 which follow, which results are intended primarily to illustrate the various combinations of components that were investigated.

Each test is identified by a number, the first number indicating the series and the rest indicating the number of the test within that series.

The amount of polyester fiber is expressed as a percentage by weight on the cellulose fiber; the amount of filler is expressed as a percentage by weight on the total fiber; and the amount of each remaining component is expressed as a percentage by weight on the total furnish. Numbers in brackets refer to the order of addition in the preparation of the filler composition.

FURTHER DISCUSSION

In Example 4, as in the previous Examples, the filler compositions were prepared under normal ambient conditions, such as room temperature. In the Examples, the tests were on a laboratory scale. However, pilot runs on a continuous paper machine have indicated the feasibility of using the present invention on a commercial scale. The pilot runs employed a 70% bleached birch/30% bleached pine kraft as the cellulose stock and calcium carbonate as the filler; the flocculating agent (retention aid) was selected from Percol 292 and Percol 63; the coupling agent was selected from cold-water soluble starch, cooked starch, CMC and amphoteric guar gum; and the synthetic fiber was Dacron (trade mark) polyester; 6 mm average fiber length. Percol 1597 was used as a cationizing agent.

In certain of the tests in Example 4, the resultant sheet showed evidence of over-flocculation. However, it is believed that this is unlikely to cause problems in a paper mill owing to the high shear conditions prevailing therein. Indeed, significant problems of overflocculation were not encountered in the pilot scale runs referred to above.

It will of course be understood that the present invention has been described above purely by way of exam-

TABLE 6

(Example 4)

| Test: | 2/E2 | 2/E3 | 2/E4 | 3/E4 | 3/E6 | 3/E7 | 3/E8 | 3/E9 | 3/E10 |
|---|---|---|---|---|---|---|---|---|---|
| Polyester | 5(1) | 5(1) | 5(1) | 5(1) | 5(1) | 5(1) | 5(1) | 5(1) | 5(1) |
| Filler | 38.1(3) | 38.1(3) | 38.1(2) | 38.1(3) | 38.1(3) | 38.1(3) | 38.1(3) | 38.1(3) | 38.1(3) |
| Percol 292 | 0.045(4) | 0.045(4) | 0.030(4) | 0.021(4) | 0.021(4) | — | — | — | 0.007(4) |
| Percol 155 | — | — | — | — | — | — | — | — | — |
| Perfectamyl PLV | 1.5(2) | 1.5(2) | 1.5(2) | — | — | — | — | — | — |
| Solvitose D9 | — | — | — | 1.0(2) | — | — | — | — | — |
| Raisio RS 180 | — | — | — | — | — | — | — | — | — |
| Raisio RS 190 | — | — | — | — | 1.0(2) | 1.0(2) | 1.0(2) | 1.0(2) | 1.0(2) |
| Silica BMA | — | — | — | — | — | 0.3(4) | 0.4(4) | — | — |
| Ludox HS 40 | — | — | — | — | — | — | — | 0.5(4) | — |
| Hydrocol 0 | — | 0.20(5) | 0.20(5) | — | — | — | — | — | 0.20(5) |
| Grammage | 64.6 | 66.8(a) | 70.6(a) | 63.5 | 66.6(a) | 72.4(a) | 67.0(a) | 69.0(a) | 67.5(a) |
| Filler retained | 20.3 | 22.1 | 22.0 | 18.5 | 25.2 | 26.3 | 26.8 | 28.0 | 26.2 |
| Breaking length | 5.61 | 5.57 | 5.58 | 6.22 | 5.32 | 5.01 | 4.93 | 4.68 | 5.25 |
| Burst Factor | 40.4 | 40.9 | 38.5 | 43.4 | 36.4 | 31.2 | 31.9 | 29.9 | 34.2 |
| Tear Factor | 124 | 122 | 113 | 127 | 111 | 108 | 109 | 107 | 120 |
| App. Density | 649 | 651 | 644 | 638 | 640 | 633 | 655 | 642 | 639 |
| Opacity | 84.7 | 85.0 | 85.3 | 86.0 | 85.5 | 83.5 | 84.9 | 84.2 | 85.8 |
| Air Porosity | 7.0 | 8.0 | 6.6 | 11 | 10 | 9.2 | 8.7 | 9.2 | 10 |
| RSF | 78.0 | 78.6 | 77.4 | 87.6 | 69.0 | 68.4 | 63.7 | 60.4 | 74.5 |

| Test: | 4/E11 | 5/E1 | 5/E2 | 5/E4 | 5/E6 | 5/E8 | 5/E9 |
|---|---|---|---|---|---|---|---|
| Polyester | 5(1) | 5(1) | 5(1) | 5(1) | 5(1) | 5(1) | 5(1) |
| Filler | 38.1(3) | 38.1(3) | 38.1(3) | 38.1(3) | 38.1(3) | 38.1(3) | 38.1(3) |
| Percol 292 | — | — | — | — | — | 0.004(4) | 0.004(4) |
| Percol 155 | — | 0.0015(4) | 0.0015(4) | 0.0025(4) | 0.0020(4) | — | — |
| Perfectamyl PLV | — | — | — | — | — | — | — |
| Solvitose D9 | — | 1.0(2) | 1.0(2) | 1.0(2) | 1.5(2) | 1.0(2) | 1.5(2) |
| Raisio RS 180 | 0.5(2) | — | — | — | — | — | — |
| Raisio RS 190 | — | — | — | — | — | — | — |
| Silica BMA | — | — | — | — | — | — | — |
| Ludox HS 40 | 0.2(3,4) | — | — | — | — | — | — |
| Hydrocol 0 | — | — | 0.20(5) | 0.20(5) | 0.20(5) | 0.20(5) | 0.20(5) |
| Grammage | 69.7(a) | 71.8 | 72.1 | 65.1(a) | 68.0 | 70.8 | 69.8 |
| Filler retained | 25.4 | 17.0 | 20.5 | 19.2 | 19.8 | 19.6 | 17.6 |
| Breaking length | 4.50 | 6.06 | 5.73 | 6.14 | 6.25 | 5.51 | 5.58 |
| Burst Factor | 27.7 | 42.7 | 40.7 | 42.5 | 46.5 | 42.6 | 43.8 |
| Tear Factor | 105 | 129 | 126 | 122 | 124 | 135 | 140 |
| App. Density | 616 | 651 | 669 | 649 | 667 | 675 | 684 |
| Opacity | 85.5 | 86.5 | 86.3 | 85.3 | 84.9 | 84.4 | 84.2 |
| Air Porosity | 6.0 | 14 | 17 | 13 | 18 | 15 | 19 |
| RSF | 57.7 | 88.7 | 82.1 | 77.3 | 83.2 | 83.2 | 86.4 |

Note:
(a) overflocculated

TABLE 7

(Example 4)

| Test: | 6/E1 | 6/E2 | 6/E3 |
|---|---|---|---|
| Polyester | 5(1) | 5(1) | 5(1) |
| Filler | 38.1(3) | 38.1(3) | 38.1(3) |
| Percol 63 | — | — | 0.005(4) |
| Percol 155 | — | 0.0005(4) | — |
| Perfectamyl PLV | — | — | 1.0(2) |
| Posamyl L7 | 1.0(2) | 0.5(2) | — |
| Grammage | 69.4(a) | 69.0(a) | 67.0 |
| Filler retained | 24.2 | 25.0 | 19.6 |
| Breaking length | 4.65 | 4.42 | 5.16 |
| Burst Factor | 34.6 | 28.5 | 36.5 |
| Tear Factor | 117 | 115 | 118 |
| App. Density | 651 | 645 | 655 |
| Opacity | 84.7 | 83.8 | 84.8 |
| Air Porosity | 6.6 | 7.3 | 7.1 |
| RSF | 66.0 | 61.0 | 71.3 |

Note:
(a) overflocculated ple, and modifications of detail can be made within the scope of the invention.

What is claimed is:

1. An improved process for the manufacture of a fibrous sheet material by dewatering an aqueous slurry of fibers, and in which (a) filler particles are added to the aqueous slurry, before the dewatering, wherein the improvement is characterized by first making a filler/fiber composition of the filler particles (a) with (b) synthetic organic hydrophobic fibers by treating the fibers (b) with the filler particles (a) and with (c) a polymer that coats the fibers (b) and functions as a coupling agent between the filler particles (a) and the said fibers (b), and then incorporating said filler/fiber composition in the aqueous slurry.

2. A process according to claim 1, characterized by incorporating also (d) a flocculating agent for the filler particles (a).

3. A process according to claim 2, wherein the flocculating agent (d) is also coupling agent polymer (c).

4. A process according to any one of claims 1, 2 or 3, characterized by incorporating also (e) a colloidal inorganic polyhydroxy or polyhydrate compound.

5. A process according to any one of claim 1, 2 or 3, characterized by incorporating also a colloidal component (e) selected from colloidal silicas and colloidal bentonite clays.

6. A process according to claim 1, characterized in that the fibrous sheet material is manufactured by the draining of water from a slurry comprising cellulose fibers.

7. A process according to claim 1, characterized in that the aqueous slurry of fibers also contains a ketene dimer sizing agent.

8. A process according to claim 1 or 6, characterized in that there are introduced into the fibrous sheet filler in an amount of from 3 to 80%, the fiber (b) in an amount of from 0.5 to 60%, and the coupling agent in an amount of from 0.01 to 5.0%, the percentages being by weight of the dry sheet material.

* * * * *